US011851928B2

(12) United States Patent
Åsbo et al.

(10) Patent No.: US 11,851,928 B2
(45) Date of Patent: Dec. 26, 2023

(54) REVOLVING DOOR MOUNTING ARRANGEMENT

(71) Applicant: ASSA ABLOY ENTRANCE SYSTEMS AB, Landskrona (SE)

(72) Inventors: Sven Åsbo, Ramlösa (SE); Magnus Persson, Helsingborg (SE); Johan Persson, Billeberga (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 0 days.

(21) Appl. No.: 17/796,833

(22) PCT Filed: Feb. 18, 2021

(86) PCT No.: PCT/EP2021/053937
§ 371 (c)(1),
(2) Date: Aug. 1, 2022

(87) PCT Pub. No.: WO2021/165349
PCT Pub. Date: Aug. 26, 2021

(65) Prior Publication Data

US 2023/0050465 A1 Feb. 16, 2023

(30) Foreign Application Priority Data

Feb. 18, 2020 (SE) ..... 2030052-1

(51) Int. Cl.
*E05D 15/02* (2006.01)
*E06B 1/60* (2006.01)
*E06B 3/90* (2006.01)

(52) U.S. Cl.
CPC ..... *E05D 15/02* (2013.01); *E06B 1/6015* (2013.01); *E06B 3/90* (2013.01); *E05Y 2900/132* (2013.01)

(58) Field of Classification Search
CPC ..... E05F 15/608; E06B 3/90; E06B 1/6015; E05D 15/02
(Continued)

(56) References Cited

U.S. PATENT DOCUMENTS 2,523,980 A * 9/1950 Whiteford ..... E06B 3/90 49/44
3,364,620 A * 1/1968 Hess ..... E06B 3/90 49/43
(Continued)

FOREIGN PATENT DOCUMENTS

CN 100547221 10/2009
CN 201401110 2/2010
(Continued)

OTHER PUBLICATIONS

International Search Report and Written Opinion in PCT/EP2021/053937 dated Apr. 16, 2021.
Swedish Search Report in 2030052-1 dated Sep. 25, 2020.

*Primary Examiner* — Justin B Rephann
(74) *Attorney, Agent, or Firm* — Wissing Miller LLP

(57) ABSTRACT

The disclosure relates to a revolving door mounting arrangement (1) for mounting a drive ring (2) of a revolving door (4), the mounting arrangement (2) comprising: at least one hook element (6) configured to be pivotably connected to a wall element (8) of the revolving door (4); and at least one connecting part (10) of the drive ring (2), which at least one connecting part (10) is configured to pivotally displace the at least one hook element (6) during mounting of the drive ring (2), and which at least one connecting part (10) is configured to rest on the at least one hook element (6) in a mounted condition of the drive ring (2). The hook element (6) comprises: a first surface (12) configured to permit the at least one connecting part (10) of the drive ring (2) to slide on and along the first surface (12) during mounting of the
(Continued)

Figure 1:
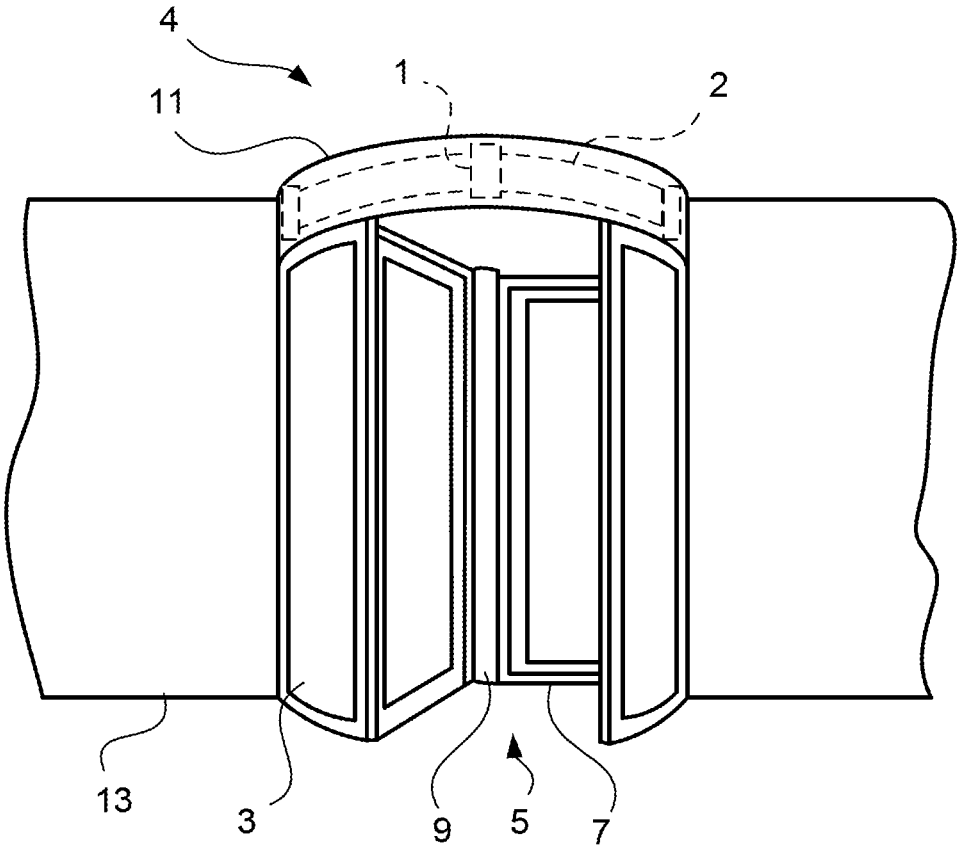

drive ring (2) for pivotally displacing the at least one hook element (6); and a second surface (14) configured to receive the at least one connecting part (10) of the drive ring (2) in the mounted condition of the drive ring (2). The disclosure further relates to a revolving door (4) comprising a drive ring (2). The disclosure further relates to a method for mounting a drive ring (2) of a revolving door (4) by means of a revolving door mounting arrangement (1).

20 Claims, 6 Drawing Sheets

(58) Field of Classification Search
USPC ..... 49/42–44
See application file for complete search history.

(56) References Cited

U.S. PATENT DOCUMENTS 4,660,322 A * 4/1987 Lowe ..... E05D 15/02 49/44
4,763,053 A * 8/1988 Rabe ..... H02K 15/0407 318/400.41
4,970,825 A * 11/1990 Knarvik ..... E05D 15/02 49/44
4,976,065 A * 12/1990 Beran ..... E05D 15/02 192/105 CD
4,980,992 A * 1/1991 Liles ..... E06B 3/90 49/44
6,266,922 B1 * 7/2001 Rockenbach ..... E05F 15/608 49/42
9,091,109 B2 * 7/2015 Busch ..... E05F 15/608
2012/0005961 A1 * 1/2012 Busch ..... E05F 15/608 49/46
2014/0196375 A1 * 7/2014 Busch ..... E05F 15/40 49/46

FOREIGN PATENT DOCUMENTS

| | | |
|---|---|---|
| DE | 202017107378 | 1/2018 |
| JP | 0742852 | 8/1995 |
| JP | 2002295122 | 10/2002 |
| KR | 20200040646 | 4/2020 |

* cited by examiner

REVOLVING DOOR MOUNTING ARRANGEMENT

This application is a 371 of PCT/EP2021/053937, filed on Feb. 18, 2021, published on Aug. 26, 2021 under publication number WO 2021/165349, which claims priority benefits from Swedish Patent Application No. 2030052-1, filed on Feb. 18, 2020, the disclosure of which is incorporated herein by reference.

FIELD OF THE INVENTION

The present invention relates to a revolving door mounting arrangement. More specifically, the disclosure relates to a revolving door mounting arrangement as defined in the introductory part of claim 1. The disclosure also relates to a method for mounting a drive ring of a revolving door as defined in the introductory part of claim 16.

BACKGROUND ART

Revolving doors are used for entry and exit of buildings. The revolving doors usually have curved side walls, between which a rotor centrally revolves. Two, three or more rotor wings, which are offset relative to each other at identical angular distances in the circumferential direction are arranged extending in the radial direction from a central rotor axis.

Revolving doors are manufactured in different sizes. The size of a revolving door may be dependent on the number of people that are expected to walk through the revolving door. In order to meet the required size, the revolving door is manufactured based on the desired size and assembled on site by construction workers. The revolving door may be installed outside or inside a frontage wall or in the center of a wall of the building.

Revolving doors may be driven by an electric drive motor, which usually is coupled to the rotor of the revolving door via a transmission in a rotationally secure manner. The drive motor and transmission may be located in and mounted to the ceiling construction above the door panels of the revolving door. A bearing, which is guiding the central rotor axis may also be mounted to the ceiling construction. The location of the drive motor, the transmission and the baring above the door panels may require a robust and heavy ceiling construction. In addition, the height of the revolving door may be increased due to the location of the drive motor and transmission in the ceiling construction.

In order to achieve a robust and rigid ceiling construction for the drive motor, the transmission and the baring above the door panels a drive ring of steel is mounted to the ceiling construction.

SUMMARY

During assembling and installation of the revolving door the drive ring is lifted by the construction workers to the height of the ceiling construction of the revolving door. Due to the considerable weight of the drive ring, security is important in order to avoid injury.

It is an object to mitigate, alleviate or eliminate the above-identified deficiencies in the art and disadvantages singly or in any combination and solve at least the above-mentioned problem.

According to a first aspect there is provided a revolving door mounting arrangement for mounting a drive ring of a revolving door, the mounting arrangement comprising: at least one hook element configured to be pivotably connected to a wall element of the revolving door; and at least one connecting part of the drive ring, which at least one connecting part is configured to pivotally displace the at least one hook element during mounting of the drive ring, and which at least one connecting part is configured to rest on the at least one hook element in a mounted condition of the drive ring; wherein the hook element comprises: a first surface configured to permit the at least one connecting part of the drive ring to slide on and along the first surface during mounting of the drive ring for pivotally displacing the at least one hook element; and a second surface configured to receive the at least one connecting part of the drive ring in the mounted condition of the drive ring. This will facilitate the mounting of the heavy drive ring of the revolving door. By the mounting arrangement, injuries will be avoided during mounting of the heavy drive ring. The configuration of the mounting arrangement will make it possible for construction workers to handle and mounting the heavy drive ring using both hands on the drive ring during the entire mounting process. When lifting the driving ring upwards in the direction of the ceiling, the connecting part of the drive ring will push the hook element out of the way for the drive ring by pivotally displacing the at least one hook element. This is possible by permitting the connecting part of the drive ring to slide on and along the first surface of the hook element during mounting of the drive ring. When the drive ring has been lifted over the hook element and the connecting part of the drive ring has passed by the hook element, the hook element will return to a position from where it was displaced, so that the second surface of the hook element can receive the at least one connecting part of the drive ring.

The drive ring has a circular shape and may comprise a circular track for rollers or wheels. The driving ring may be a reinforcement element in the structure of the revolving door. The drive ring may provide a robust and rigid ceiling construction for a drive motor, a transmission and connected to the revolving door. Thus, the drive ring may be a circular reinforcement element. Thus, the driving ring may form a part of the structure of the revolving door.

The drive ring may be a circular reinforcement element comprising the circular track for rollers or wheels for guiding the door panels.

The hook element may have a hook shape provided with the first surface and the second surface. The hook element is configured to be pivotally displaced. Thus, the first surface and the second surface are configured to be pivotally displaced.

The connecting part is configured to rest on the second surface of the hook element in a mounted condition of the drive ring. Thus in a mounted condition of the drive ring, the connecting part is connected both to the drive ring and to the hook element. The connecting part may be connected to the drive ring in any suitably way, such as by fasteners, by welds and/or by glue.

According to an aspect the at least one connecting part of the drive ring is an integrated part of the periphery of the drive ring. The connecting part may be a piece of the drive ring. The drive ring and the connecting part may be made in one piece. The drive ring may be configured in one piece by for example a casting process. During the configuration of the drive ring also the connecting part may be configured. When the connecting part and the drive ring is an single piece the number of components of the revolving door mounting arrangement is reduced.

According to an aspect the at least one connecting part of the drive ring is a separate element attached at the periphery of the drive ring. The connecting part may be connected as a separate element to the drive ring in any suitably way, such as by fasteners, by welds and/or by glue. When the connecting part is a separate element attached to the drive ring, the connecting part may be replaced by another connecting part if needed.

According to an aspect the at least one connecting part of the drive ring comprises a recess, configured to receive a protrusion of the at least one hook element in the mounted condition of the drive ring. The protrusion of the hook element is configured to protrude into the recess of the connected part. Such a configuration will prevent the drive ring from moving in relation to the hook element in the mounted condition of the drive ring. In addition, when the protrusion is received in the recess, an indication is received the drive element has a correct position in relation to the hook element in the mounted condition of the drive ring.

According to an aspect the at least one hook element is configured to be pivotally displaced from a first position to a second position during mounting of the drive ring, wherein the drive ring is able to pass by the at least one hook element when the at least one hook element is pivotally displaced to the second position, and wherein the at least one hook element is configured to pivotally return to the first position to support the drive ring in the mounted condition of the drive ring. When lifting the driving ring upwards in the direction of the ceiling, the connecting part of the drive ring will push the hook element out of the way for the drive ring by pivotally displacing the at least one hook element. This is possible by permitting the connecting part of the drive ring to slide on and along the first surface of the hook element during mounting of the drive ring. When the drive ring has been lifted over the hook element and the connecting part of the drive ring has passed by the hook element, the hook element will return to a position from where it was displaced, so that the second surface of the hook element can receive the at least one connecting part of the drive ring. This will facilitate the mounting of the heavy drive ring of the revolving door.

According to an aspect the first position is an equilibrium of the at least one hook element and wherein the at least one hook element is configured to pivotally return to the first position by gravity. The hook element may be configured to pivot about a pivoting shaft arranged in an upper part of the hook element. The lower part of the hook element may be comprise its centre of gravity so that the hook element will pivotally return to the hook element to the first position by gravity. The pivoting shaft may be arranged in the ceiling, in the side walls of the revolving door or in any other construction element connected to the revolving door.

According to an aspect a spring element is configured to urge the at least one hook element to the first position. The spring element may be a compression spring that pushes the hook element back to the first position. The spring element may be a tension spring that draws the hook element back to the first position.

According to an aspect the first surface of the at least one hook element is inclined in relation to the second surface of the at least one hook element. The inclined first surface of the hook element is leaning downwards when the hook element is in the first position. When lifting the driving ring upwards in the direction of the ceiling, the connecting part of the drive ring will slide along the inclined first surface and push the hook element out of the way for the drive ring by pivotally displacing the hook element.

According to an aspect a normal of the first surface of the at least one hook element extend with an angle in relation to the extension of a normal of the second surface of the at least one hook element. The second surface may have a horizontal configuration when the hook element is in the first position. The normal to the second surface of the hook element may thus have a vertical extension when the hook element is in the first position. The normal of the first surface may extend with an angle in relation to the extension of a normal of the second surface of the at least one hook element in order to achieve an inclined first surface of the hook element, leaning downwards when the hook element is in the first position.

According to an aspect the angle between the normal of the first surface and the normal of the second surface is in the range of 25°-65°, preferably the angle between the normal of the first surface and the normal of the second surface is 45°. These angels may provide for the connecting part of the drive ring to slide along the inclined first surface and push the hook element out of the way for the drive ring by pivotally displacing the hook element when lifting the driving ring upwards in the direction of the ceiling.

According to an aspect the at least one hook element and the at least one connecting part of the drive ring are attachable by a first fastener element in the mounted condition of the drive ring. Attaching the connecting part to the hook element will secure the drive ring in the mounted position.

According to an aspect the at least one connecting part of the drive ring is provided with a first bore and the second surface of the at least one hook element is provided with a second bore, which first and second bores are configured to receive the first fastener element. The first fastener element may be a threaded screw or bolt, which releasably connects the connecting part with the hook element. Releasably connecting the connecting part with the hook element will facilitate any demounting of the drive ring from the hook element.

According to an aspect the at least one hook element in the mounted condition of the drive ring is attachable to the wall element of the revolving door by a second fastener element. When the hook element has returned to the first position and the connecting part rests on the second surface of the hook element, the hook element is secured to the wall element of the revolving door by a second fastener element. Securing the hook element to the wall element of the revolving door by the second fastener element will prevent any pivotal movement of the hook element. Preventing pivotal movement of the hook element in the mounted condition of the driving will prevent any movement of the drive ring.

According to an aspect at least three hook elements are distributed around the inner periphery of the wall element, and wherein at least three connecting parts are distributed around the outer periphery of the drive ring. Such distribution of at least three hook elements and connection elements around the inner periphery of the wall element and the around the outer periphery of the drive ring will stabilize the mounted drive ring.

According to a second aspect there is provided a revolving door comprising a drive ring, wherein the revolving door comprising a revolving door mounting arrangement disclosed herein. The revolving door mounting arrangement may be a part of the revolving door, which facilitates mounting of the drive ring in the revolving door, and which secures the mounted drive ring in the revolving door.

According to a third aspect there is provided a method, for mounting a drive ring of a revolving door by means of a revolving door mounting arrangement, the mounting arrangement comprising: at least one hook element configured to be pivotably connected to a wall element of the revolving door; and at least one connecting part of the drive ring, which at least one connecting part is configured to pivotally displace the at least one hook element during mounting of the drive ring, and which at least one connecting part is configured to rest on the at least one hook element in a mounted condition of the drive ring; wherein the hook element comprises: a first surface configured to permit the at least one connecting part of the drive ring to slide on and along the first surface during mounting of the drive ring for pivotally displacing the at least one hook element; and a second surface configured to receive the at least one connecting part of the drive ring in the mounted condition of the drive ring, wherein the method comprising the steps of: hoisting the drive ring upwards of the revolving door; pivotally displacing the at least one hook element by means of the at least one connecting part of the drive ring; pivotally returning the at least one hook element when the at least one connecting part of the drive ring has passed by the at least one hook element; and lowering the drive ring until the drive ring rests on the at least one hook element. The method will facilitate the mounting of the heavy drive ring of the revolving door. Injuries will be avoided during mounting of the heavy drive ring using the method. Construction workers may hoist the drive ring upwards of the revolving door using both hands on the drive ring. When lifting the driving ring upwards in the direction of the ceiling, the connecting part of the drive ring will push the hook element out of the way for the drive ring by pivotally displacing the at least one hook element. This is possible by permitting the connecting part of the drive ring to slide on and along the first surface of the hook element during mounting of the drive ring. When the drive ring has been lifted over the hook element and the connecting part of the drive ring has passed by the hook element, the hook element will automatically return to a position from where it was displaced. Thereafter the drive ring is lowered until the drive ring rests on the at least one hook element. The method may be performed by construction workers. The method may be performed automatically by a machine. The method may be performed by construction workers and a machine.

According to an aspect the method comprises the further step of securing the drive ring to the at least one hook element. When the drive ring rests on the at least one hook element, the drive ring may be secured to the at least one hook element by a fastener element, by welding, a snap fastener or the like. A threaded screw or bolt may be used as fastener element.

A further scope of applicability of the present invention will become apparent from the detailed description given below. However, it should be understood that the detailed description and specific examples, while indicating preferred embodiments of the invention, are given by way of illustration only. Various changes and modifications within the scope of the invention will become apparent to those skilled in the art from the detailed description.

Hence, it is to be understood that the herein disclosed invention is not limited to the particular component parts of the device described or steps of the methods described since such device and method may vary. It is also to be understood that the terminology used herein is for purpose of describing particular embodiments only, and is not intended to be limiting. It should be noted that, as used in the specification and the appended claim, the articles "a", "an", "the", and "said" are intended to mean that there are one or more of the elements unless the context explicitly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTIONS OF THE DRAWINGS

The above objects, as well as additional objects, features and advantages of the present invention will be more fully appreciated by reference to the following illustrative and non-limiting detailed description of example embodiments of the present invention, when taken in conjunction with the accompanying drawings.

Figure 2:
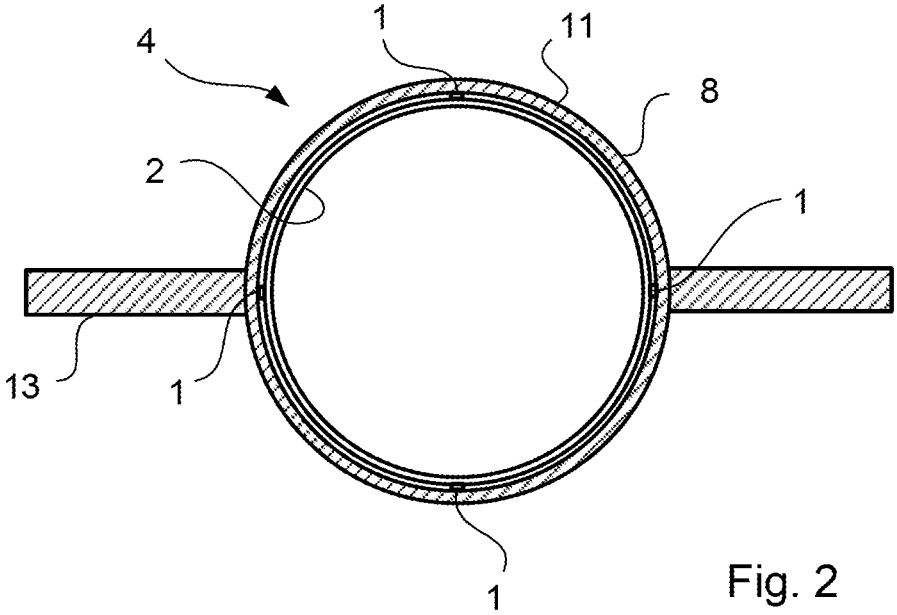
Figure 3:
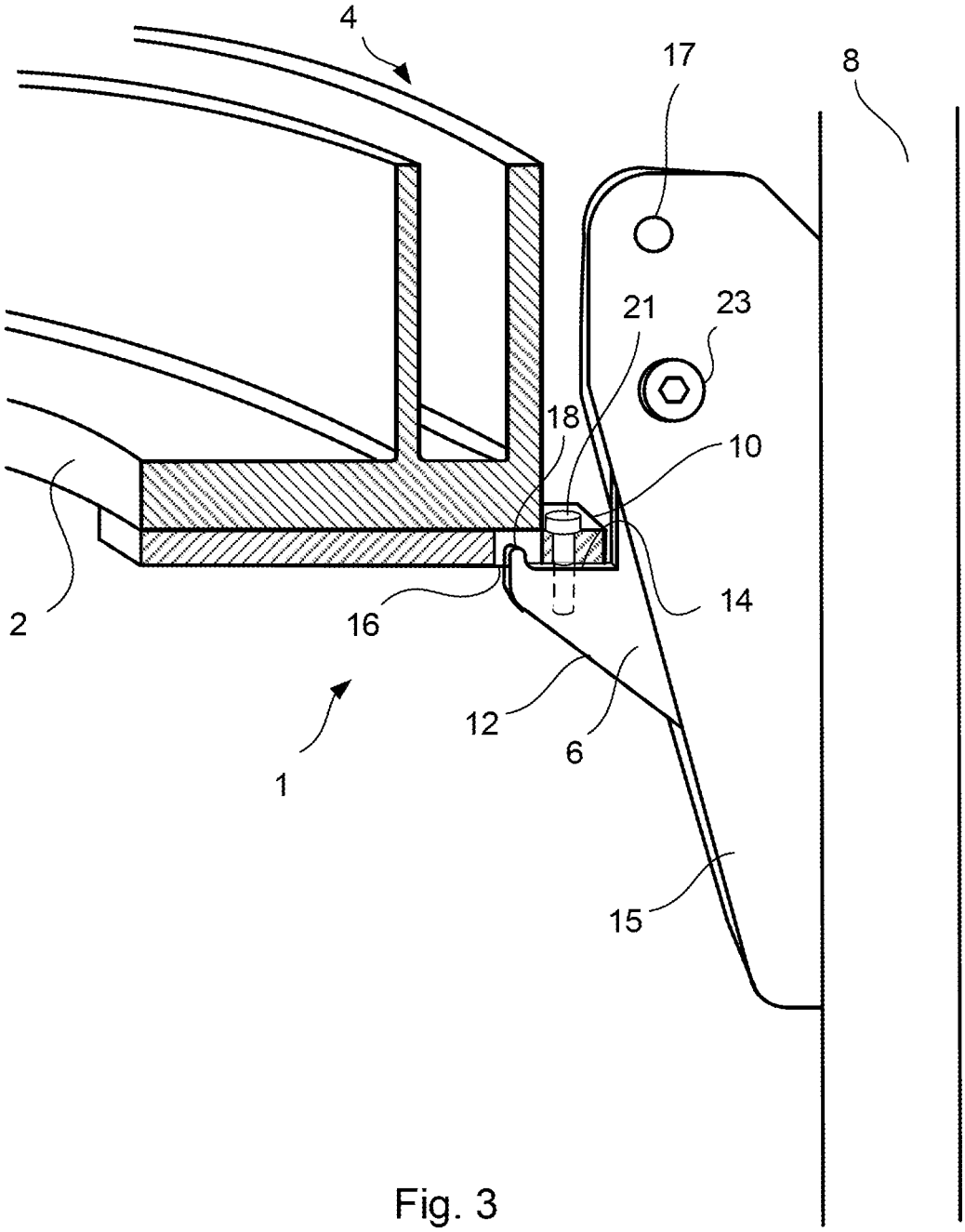
Figure 4:
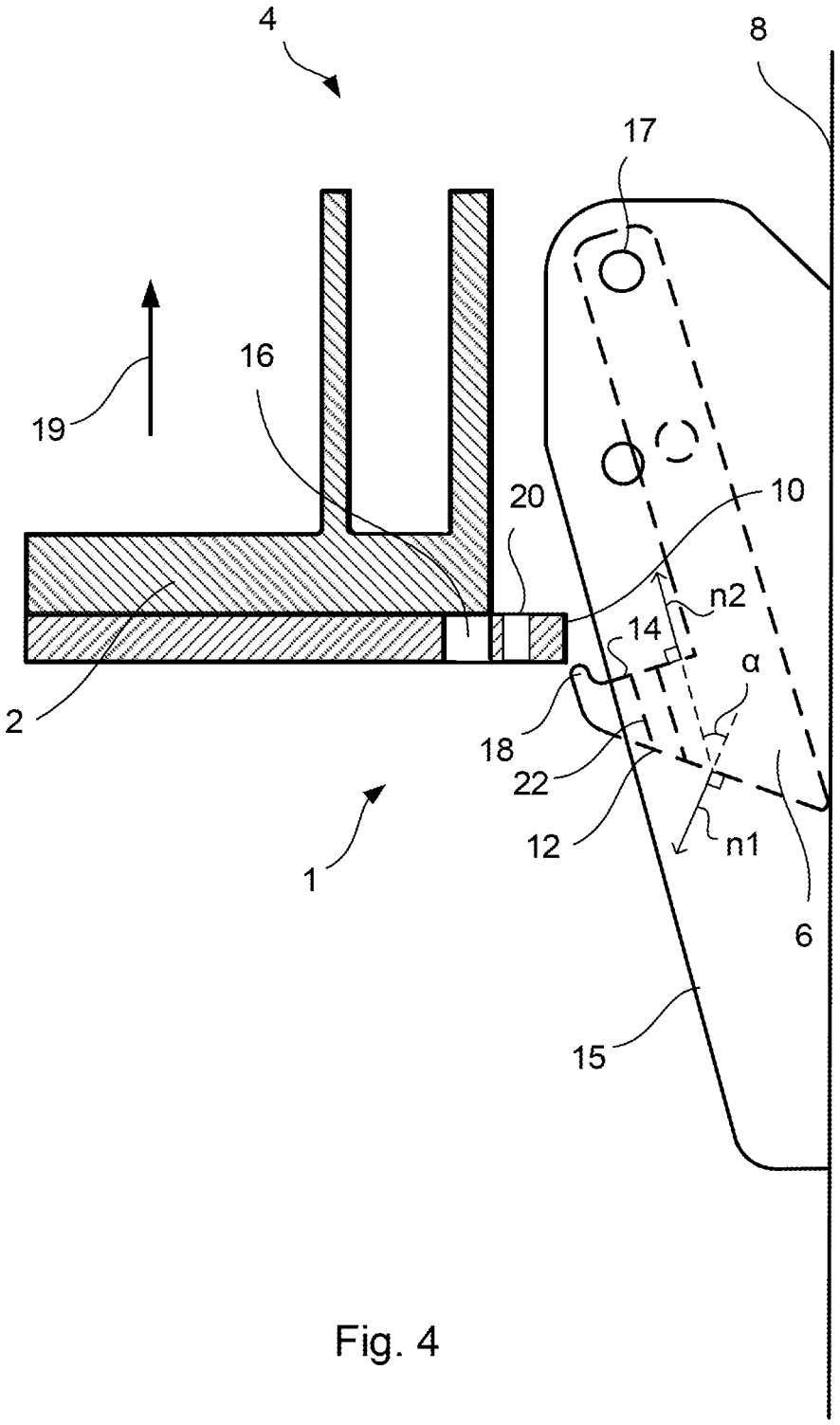
Figure 5:
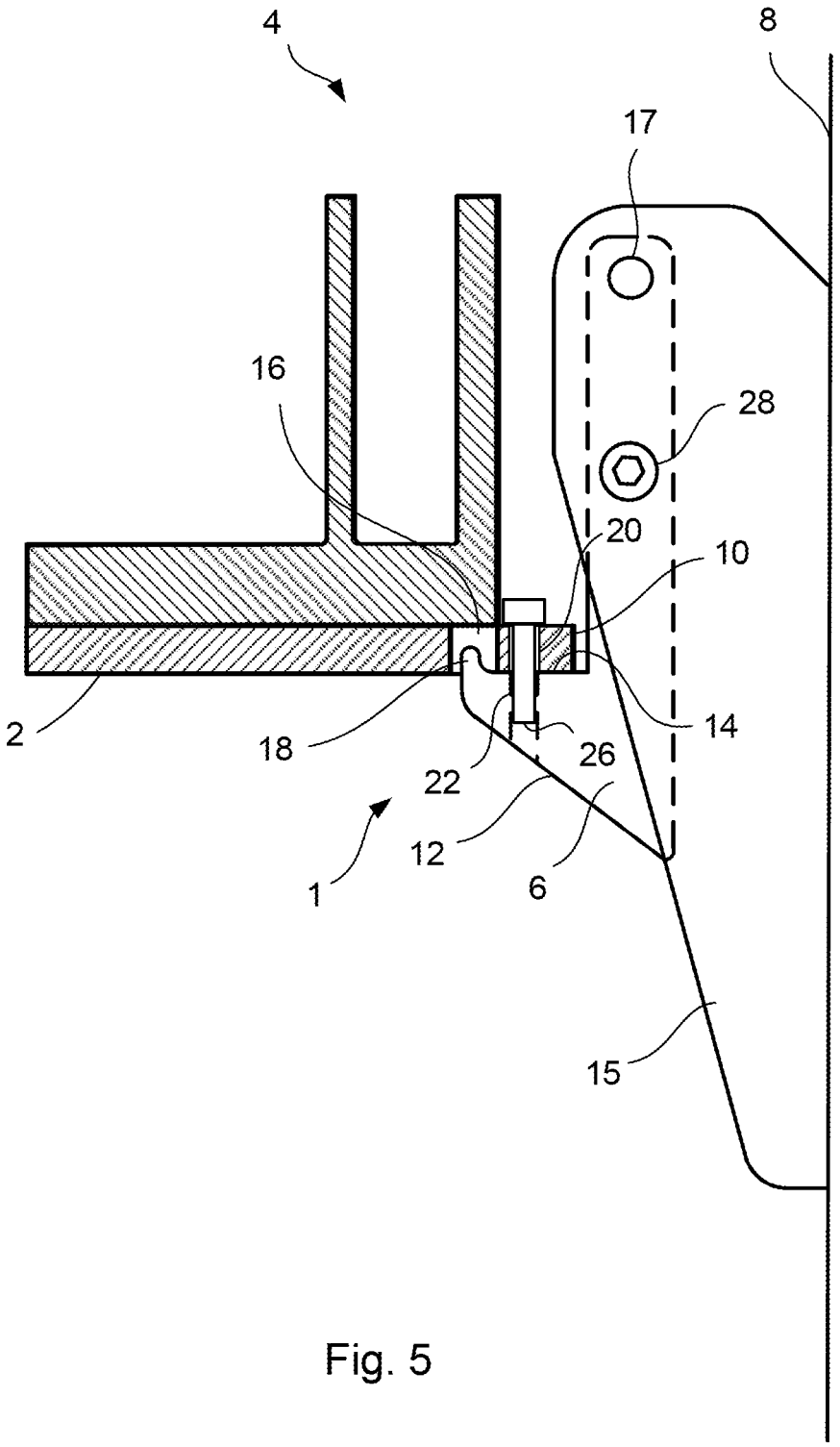
Figure 6:
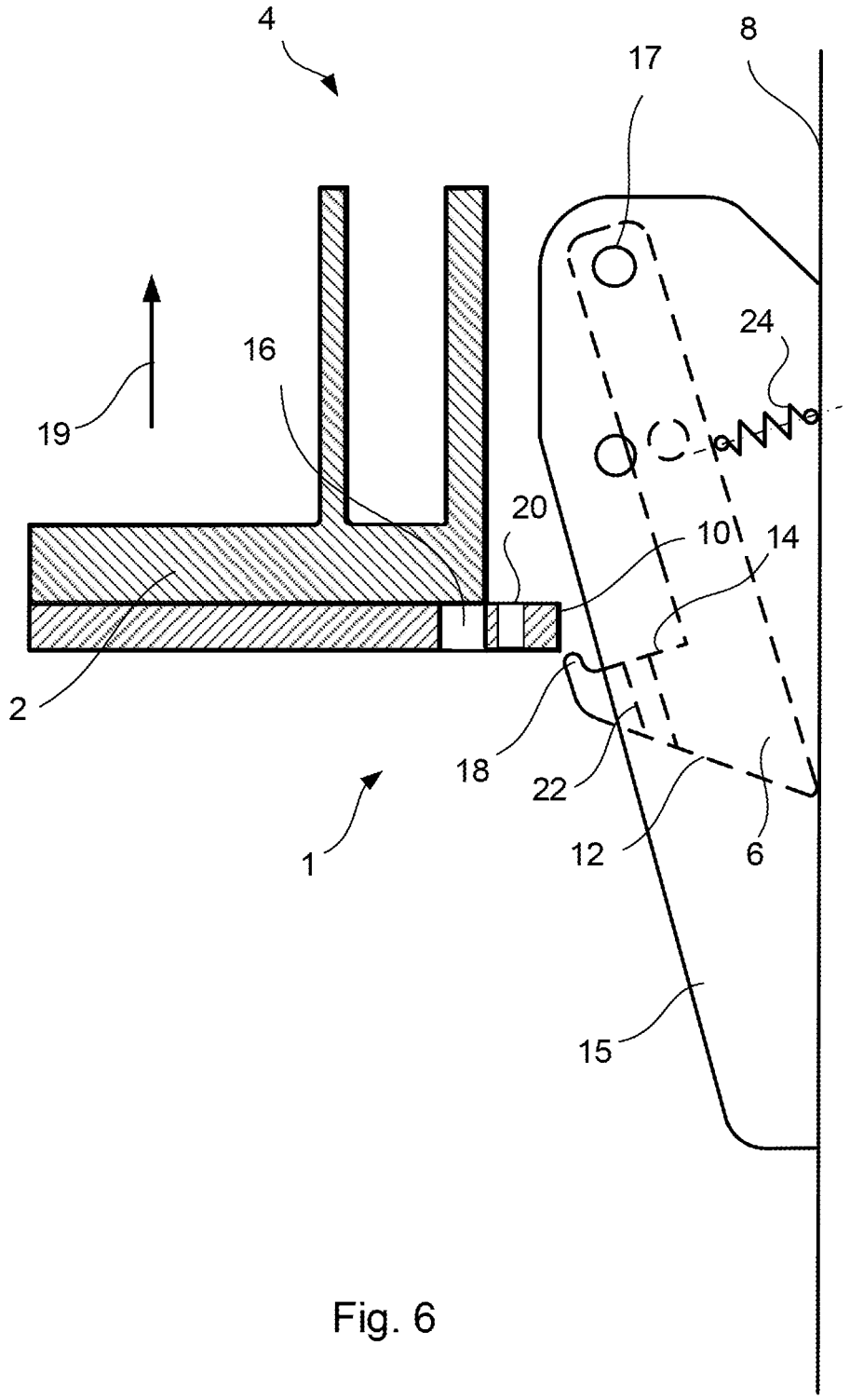
Figure 7:
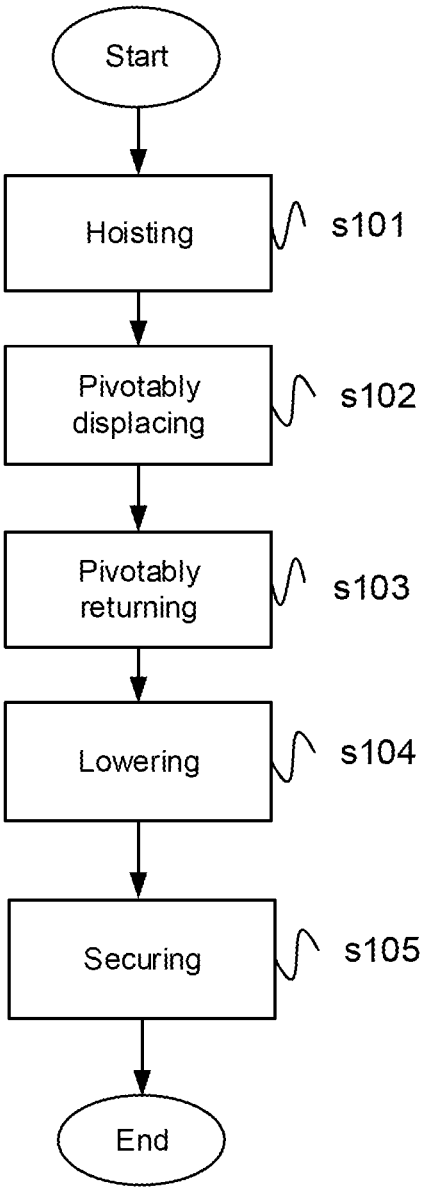

FIG. 1 shows a schematic view in perspective of a revolving door provided with a revolving door mounting arrangement for mounting a drive ring of a revolving door according to the invention, FIG. 2 shows a schematic cross sectional view from above of a revolving door provided with a revolving door mounting arrangement for mounting the drive ring according to the invention, FIG. 3 shows a schematic view in perspective of a drive ring and a revolving door mounting arrangement for mounting the drive ring of a revolving door according to the invention, FIG. 4 shows a section view of a drive ring and a revolving door mounting arrangement for mounting the drive ring of a revolving door according to the invention, FIG. 5 shows a section view of a drive ring and a revolving door mounting arrangement for mounting the drive ring of a revolving door according to the invention, FIG. 6 shows a section view of a drive ring and a revolving door mounting arrangement for mounting the drive ring of a revolving door according to the invention, and FIG. 7 illustrates a flow chart of a method for mounting a drive ring of a revolving door by means of a revolving door mounting arrangement according to the invention.

DETAILED DESCRIPTION

The present disclosure will now be described with reference to the accompanying drawings, in which currently preferred example aspects and embodiments of the disclosure are shown. This disclosure may, however, be embodied in many different forms and should not be construed as limited to the herein disclosed embodiments. The disclosed aspects and embodiments are provided to fully convey the scope of the disclosure to the skilled person.

FIG. 1 shows a schematic view in perspective of a revolving door 4 provided with a revolving door mounting arrangement 1 for mounting a drive ring 2 of the revolving door 4. The revolving door 4 comprises curved side walls 3, between which a rotor 5 centrally revolves. Three door panels 7 are arranged extending in the radial direction from a central rotor axis 9. An electric drive motor (not disclosed) is connected to the central rotor axis 9. Rotating the central rotor axis 9 by means of the drive motor will also rotate the door panels 7 connected to the central rotor axis 9. The drive motor is located in and mounted to a ceiling construction 11 above the door panels 7 of the revolving door 4. The drive ring 2 is mounted to the ceiling construction 11 in order to achieve a robust and rigid ceiling construction 11. The revolving door mounting arrangement 1 for mounting the drive ring 2 is also arranged at the ceiling construction 11 of the revolving door 4. The revolving door 4 is installed in a building wall 13.

FIG. 2 shows a schematic cross sectional view from above of a revolving door 4 provided with the revolving door mounting arrangement 1 for mounting the drive ring 2. The revolving door mounting arrangement 1 comprising four hook elements 6 (FIG. 3), which are distributed around the inner periphery of a wall element 8, which are connected to connecting parts 10 (FIG. 3) distributed around the outer periphery of the drive ring 2. The wall element 8 may be a part of the ceiling construction 11. The number of connecting parts 10 are equal to the number of hook elements 6. At least three hook elements 6 may be distributed around the inner periphery of the wall element 8. At least three connecting parts 10 may be distributed around the outer periphery of the drive ring 2.

FIG. 3 shows a schematic view in perspective of the drive ring 2 and the revolving door mounting arrangement 1 for mounting the drive ring 2 of a revolving door 4 according to the invention. The revolving door mounting arrangement 1 comprising the hook element 6, which is configured to be pivotably connected to the wall element 8 of the revolving door 4. A bracket 15 is attached to the wall element and pivot shaft 17 is arranged in the bracket 8. The hook element 6 is pivotably arranged on the pivot shaft 17. The mounting arrangement 1 also comprising the connecting part 10 of the drive ring 2. The connecting part 10 is configured to pivotally displace the hook element 6 during mounting of the drive ring 2. The connecting part 10 is configured to rest on the hook element 6 in a mounted condition of the drive ring 2. In FIG. 3 the drive ring 2 is shown in the mounted condition. The hook element 6 is pivotally displaceable between a first and second position. The first position of the hook element 6 is shown FIG. 3. The hook element 6 comprises a first surface 12 configured to permit the connecting part 10 of the drive ring 2 to slide on and along the first surface 12 during mounting of the drive ring 2 for pivotally displacing the hook element 6 to the second position. In addition, the hook element 6 comprises a second surface 14 configured to receive the connecting part 10 of the drive ring 2 in the mounted condition of the drive ring 2. The connecting part 10 of the drive ring 2 may be a separate element attached at the periphery of the drive ring 2. However, the connecting part 10 may be an integrated part of the periphery of the drive ring 2. Thus, the drive ring 2 and the connecting part 10 may be made in one piece. The connecting part 10 of the drive ring 2 comprises a recess 16, configured to receive a protrusion 18 of the hook element 6 in the mounted condition of the drive ring 2. The hook element 6 and the connecting part 10 of the drive ring 2 are attachable by a first fastener element 21 in the mounted condition of the drive ring 2. The hook element 6 is in the mounted condition of the drive ring 2 attachable to the wall element 8 of the revolving door 4 by a second fastener element 23. The second fastener element 23 prevents the hook element from pivoting about the pivot shaft 17.

FIG. 4 shows a section view of the drive ring 2 and a revolving door mounting arrangement 1 for mounting the drive ring 2 of a revolving door 4 according to the invention. When lifting the drive ring 2 upwards in the direction of the ceiling construction 11, the connecting part 10 of the drive ring 2 will push the hook element 6 out of the way for the drive ring 2 by pivotally displacing the at least one hook element 6. In FIG. 4, the lifting direction of the drive ring 2 upwards in the direction of the ceiling construction 11 is indicated by an arrow 19. This is possible by allowing the connecting part 10 of the drive ring 2 to slide on and along the first surface 12 of the hook element 6 during mounting of the drive ring 2. The first surface 12 of the hook element 6 is inclined in relation to the second surface 14 of the hook element 6. The inclined first surface 12 of the hook element 6 is leaning downwards when the hook element 6 is in the first position. When lifting the driving ring 2 upwards in the direction of the ceiling construction 11, the connecting part 10 of the drive ring 2 will slide along the inclined first surface 12 and push the hook element 6 out of the way for the drive ring 2 by pivotally displacing the hook element 6. In FIG. 4, the drive ring 2 has pushed the hook element 6 to the second position and the drive ring has passed by the first surface 12 and also the protrusion 18 of the hook element 6. This is possible when the second fastener element 23 (FIG. 3) has been removed, so that the hook element 6 is allowed to pivot about the pivot shaft 17. The connecting part 10 of the drive ring 2 is provided with a first bore 20. The second surface 14 of the hook element 6 is provided with a second bore 22. The first and second bores 20, 22 are configured to receive the first fastener element 21 (FIG. 3).

A normal n1 of the first surface 12 of the hook element 6 extend with an angle $\alpha$ in relation to the extension of a normal n2 of the second surface 14 of the hook element 6. The second surface 14 may have a horizontal configuration when the hook element 6 is in the first position (FIG. 5). The normal n2 to the second surface 14 of the hook element 6 may thus have a vertical extension when the hook element 6 is in the first position. The normal n1 of the first surface 12 extends with an angle $\alpha$ in relation to the extension of a normal n2 of the second surface 14 of the hook element 6 in order to achieve an inclined first surface 12 of the hook element 6, leaning downwards when the hook element 6 is in the first position.

The angle $\alpha$ between the normal n1 of the first surface 12 and the normal n2 of the second surface 14 is in the range of 25°-65°. The angle $\alpha$ between the normal n1 of the first surface 12 and the normal n2 of the second surface 14 may be 45°. These angles $\alpha$ may provide for the connecting part of the drive ring 2 to slide along the inclined first surface 12 and push the hook element 6 out of the way for the drive ring 2 by pivotally displacing the hook element 6 when lifting the driving ring 6 upwards in the direction in or of the ceiling construction 11.

FIG. 5 shows a section view of the drive ring 2 and the revolving door mounting arrangement 1 for mounting the drive ring 2 of the revolving door 4 according to the invention. In FIG. 5 the drive ring 2 is shown in the mounted condition. The hook element 6 has been pivotally returned from the second position (FIG. 4) to the first position. The first position may be an equilibrium of the hook element 6. In FIG. 5 the hook element 6 has pivotally return from the second position to the first position by gravity.

The connecting part 10 rests on the hook element 6 and the recess 16 of the connecting part 10 has received the protrusion 18 of the hook element 6. The hook element 6 and the connecting part 10 of the drive ring 2 are connected and attached by the first fastener element 21. The hook element 6 has been attachable to the bracket 15 of the wall element 8 of the revolving door 4 by the second fastener element 23.

FIG. 6 shows a section view of the drive ring 2 and the revolving door mounting arrangement 1 for mounting the drive ring 2 of the revolving door 4 according to the invention. A spring element 24 may be configured to urge the hook element 6 to the first position. The spring element may be a compression spring that pushes the hook element back to the first position. The spring element 24 may be arranged between the hook element 6 and the wall element 8. Alternatively or in combination, the spring element 24 may be a tension spring that draws the hook element 6 back to the first position.

FIG. 7 illustrates a flow chart of a method, for mounting a drive ring 2 of a revolving door 4 by means of a revolving door mounting arrangement 1. The method thus relates to the revolving door mounting arrangement 1 disclosed in FIGS. 1-6. Thus, the mounting arrangement 1 comprising the at least one hook element 6 configured to be pivotably connected to the wall element 8 of the revolving door 4. The connecting part 10 of the drive ring 2 is configured to pivotally displace the at least one hook element 6 during mounting of the drive ring 2. The connecting part 10 is configured to rest on the hook element 6 in a mounted condition of the drive ring 2. The hook element 6 comprises the first surface 12 configured to permit the connecting part 10 of the drive ring 2 to slide on and along the first surface 12 during mounting of the drive ring 2 for pivotally displacing the hook element 6, and the second surface 14, which is configured to receive the connecting part 10 of the drive ring 2 in the mounted condition of the drive ring 2.

The method comprises the steps of: hoisting s101 the drive ring 2 upwards of the revolving door 4; pivotally displacing s102 the at least one hook element 6 by means of the at least one connecting part 10 of the drive ring 1; pivotally returning s103 the at least one hook element 6 when the at least one connecting part of the drive ring 2 has passed by the at least one hook element 6; and lowering s104 the drive ring 2 until the drive ring 2 rests on the at least one hook element 4.

The method may comprise the further step of securing s105 the drive ring 2 to the at least one hook element 6. When the drive ring 2 rests on the at least one hook element 6, the drive ring 2 may be secured to the at least one hook element 6 by the first fastener element 21, by welding, a snap fastener or the like.

The person skilled in the art realizes that the present invention is not limited to the preferred embodiments described above. The person skilled in the art further realizes that modifications and variations are possible within the scope of the appended claims. Additionally, all aspects and embodiments of the invention could be combined with the other aspects and embodiments of the invention. Additionally, variations to the disclosed embodiments can be understood and effected by the skilled person in practicing the claimed invention, from a study of the drawings, the disclosure, and the appended claims.

The invention claimed is:

1. A revolving door mounting arrangement for mounting a drive ring of a revolving door, the mounting arrangement comprising:

at least one hook element configured to be pivotably connected to a wall element of the revolving door; and at least one connecting part of the drive ring, wherein the at least one connecting part is configured to pivotally displace the at least one hook element during mounting of the drive ring, and wherein the at least one connecting part is configured to rest on the at least one hook element in a mounted condition of the drive ring; wherein the hook element comprises:

a first surface configured to permit the at least one connecting part of the drive ring to slide on and along the first surface during mounting of the drive ring for pivotally displacing the at least one hook element; and a second surface configured to receive the at least one connecting part of the drive ring in the mounted condition of the drive ring.

2. The mounting arrangement according to claim 1, wherein the at least one connecting part of the drive ring is an integrated part of the periphery of the drive ring.

3. The mounting arrangement according to claim 1, wherein the at least one connecting part of the drive ring comprises a connecting part element fastened with the drive ring.

4. The mounting arrangement according to claim 1, wherein the at least one connecting part of the drive ring comprises a recess, configured to receive a protrusion of the at least one hook element in the mounted condition of the drive ring.

5. The mounting arrangement according to claim 1, wherein the first surface of the at least one hook element is inclined in relation to the second surface of the at least one hook element.

6. The mounting arrangement according to claim 1, wherein a normal of the first surface of the at least one hook element is at an angle ($\alpha$) in relation to a normal of the second surface of the at least one hook element.

7. The mounting arrangement according to claim 6, wherein the angle ($\alpha$) between the normal of the first surface and the normal of the second surface is in the range of 25°-65°.

8. The mounting arrangement according to claim 7, wherein the angle between the normal of the first surface and the normal of the second surface is about 45°.

9. The mounting arrangement according to claim 1, wherein the at least one hook element and the at least one connecting part of the drive ring are attachable by a first fastener element in the mounted condition of the drive ring.

10. The mounting arrangement according to claim 9 wherein the at least one connecting part of the drive ring is provided with a first bore and the second surface of the at least one hook element is provided with a second bore, and wherein the first and second bores are configured to receive the first fastener element.

11. The mounting arrangement according to claim 1, wherein the at least one hook element in the mounted condition of the drive ring is attachable to the wall element of the revolving door by a fastener element.

12. The mounting arrangement according to claim 1, wherein at least three hook elements are distributed around the inner periphery of the wall element, and wherein at least three connecting parts are distributed around the outer periphery of the drive ring.

13. The revolving door comprising the revolving door mounting arrangement according to claim 1.

14. A method of mounting the drive ring of the revolving door according to claim 1, comprising the steps of:

hoisting the drive ring upwards of the revolving door;

pivotally displacing the at least one hook element by means of the at least one connecting part of the drive ring;

pivotally returning the at least one hook element when the at least one connecting part of the drive ring has passed by the at least one hook element; and lowering the drive ring until the drive ring rests on the at least one hook element.

15. The method according to claim 14, wherein the method comprises the further step of:

securing the drive ring to the at least one hook element.

16. A revolving door mounting arrangement for mounting a drive ring of a revolving door, the mounting arrangement comprising:

at least one hook element configured to be pivotably connected to a wall element of the revolving door; and at least one connecting part of the drive ring, wherein the at least one connecting part is configured to pivotally displace the at least one hook element during mounting of the drive ring, and wherein the at least one connecting part is configured to rest on the at least one hook element in a mounted condition of the drive ring; wherein the hook element comprises:

a first surface configured to permit the at least one connecting part of the drive ring to slide on and along the first surface during mounting of the drive ring for pivotally displacing the at least one hook element; and a second surface configured to receive the at least one connecting part of the drive ring in the mounted condition of the drive ring, wherein the at least one hook element is configured to be pivotally displaced from a first position to a second position during mounting of the drive ring, wherein the drive ring is able to pass by the at least one hook element when the at least one hook element is pivotally displaced to the second position, and wherein the at least one hook element is configured to pivotally return to the first position to support the drive ring in the mounted condition of the drive ring.

17. The mounting arrangement according to claim 16, wherein the first position is an equilibrium of the at least one hook element and wherein the at least one hook element is configured to pivotally return to the first position by gravity.

18. The mounting arrangement according to claim 16, wherein a spring element is configured to urge the at least one hook element to the first position.

19. A method for mounting a drive ring of a revolving door by means of a revolving door mounting arrangement, the mounting arrangement comprising:

at least one hook element configured to be pivotably connected to a wall element of the revolving door; and at least one connecting part of the drive ring, wherein the at least one connecting part is configured to pivotally displace the at least one hook element during mounting of the drive ring, and wherein the at least one connecting part is configured to rest on the at least one hook element in a mounted condition of the drive ring; wherein the hook element comprises:

a first surface configured to permit the at least one connecting part of the drive ring to slide on and along the first surface during mounting of the drive ring for pivotally displacing the at least one hook element; and a second surface configured to receive the at least one connecting part of the drive ring in the mounted condition of the drive ring, wherein the method comprising the steps of:

hoisting the drive ring upwards of the revolving door;

pivotally displacing the at least one hook element by means of the at least one connecting part of the drive ring;

pivotally returning the at least one hook element when the at least one connecting part of the drive ring has passed by the at least one hook element; and lowering the drive ring until the drive ring rests on the at least one hook element.

20. The method according to claim 19, wherein the method comprises the further step of:

securing the drive ring to the at least one hook element.

* * * * *